US010722806B2

(12) United States Patent
Boyle

(10) Patent No.: US 10,722,806 B2
(45) Date of Patent: Jul. 28, 2020

(54) AMUSEMENT PARK RIDE TUNNEL

(71) Applicant: Universal City Studios LLC, Universal City, CA (US)

(72) Inventor: Patrick Devin Boyle, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 16/148,327

(22) Filed: Oct. 1, 2018

(65) Prior Publication Data

US 2019/0030442 A1 Jan. 31, 2019

Related U.S. Application Data

(63) Continuation of application No. 14/873,731, filed on Oct. 2, 2015, now Pat. No. 10,099,149.

(51) Int. Cl.
*A63G 31/16* (2006.01)
*A63G 21/04* (2006.01)
(Continued)

(52) U.S. Cl.
CPC ..... *A63G 21/04* (2013.01); *A63G 1/02* (2013.01); *A63G 4/00* (2013.01); *A63G 7/00* (2013.01); *A63G 31/16* (2013.01)

(58) Field of Classification Search
CPC . A63G 1/00; A63G 1/34; A63G 21/00; A63G 21/18; A63G 31/00; A63G 31/16;
(Continued)

(56) References Cited

U.S. PATENT DOCUMENTS 1,397,009 A 11/1921 Maynes
5,006,072 A 4/1991 Letovsky et al.
(Continued)

FOREIGN PATENT DOCUMENTS

CN 203379591 1/2014
CN 104133491 11/2014
(Continued)

OTHER PUBLICATIONS

PCT/US2016/052874 Invitation to Pay Additional Fees dated Dec. 5, 2016.
(Continued)

*Primary Examiner* — Kien T Nguyen
(74) *Attorney, Agent, or Firm* — Fletcher Yoder, P.C.

(57) ABSTRACT

A ride system includes a tunnel, a vehicle ride path, a ride vehicle, and a projection system. The tunnel includes a first end and a second end and is curved between the first and second ends. The vehicle ride path extends within the tunnel from an entrance at the first end of the tunnel to an intermediate position within the tunnel. The second end of the tunnel is not visible from the intermediate position. The ride vehicle travels along the vehicle ride path and decelerates as the ride vehicle approaches the intermediate position. The projection system projects images onto one or more walls of the tunnel, such that the images are synchronized with the deceleration of the ride vehicle and a perceived speed of the ride vehicle, as perceived by a guest in the ride vehicle, exceeds an actual speed of the ride vehicle.

23 Claims, 13 Drawing Sheets

(51) Int. Cl.

| | |
|---|---|
| ***A63G 1/02*** | (2006.01) |
| ***A63G 4/00*** | (2006.01) |
| ***A63G 7/00*** | (2006.01) |
| *A63G 21/06* | (2006.01) |

(58) Field of Classification Search

CPC .. G03B 21/00; G03B 21/34; A63J 5/00; A63J 5/02

USPC ..... 472/59–61, 88–92, 117, 128, 130; 434/29, 55

See application file for complete search history.

(56) References Cited

U.S. PATENT DOCUMENTS

| | | | | |
|---|---|---|---|---|
| 5,253,049 | A | 10/1993 | Brooke | |
| 5,382,026 | A | 1/1995 | Harvard et al. | |
| 5,482,510 | A | 1/1996 | Ishii et al. | |
| 5,669,821 | A | 9/1997 | Prather et al. | |
| 6,095,926 | A * | 8/2000 | Hettema | A63G 31/16 104/85 |
| 6,386,984 | B1 * | 5/2002 | Hara | A63G 31/16 434/55 |
| 6,796,908 | B2 | 9/2004 | Weston | |
| 6,834,966 | B1 | 12/2004 | Moquin | |
| 8,079,916 | B2 | 12/2011 | Henry | |
| 8,179,337 | B2 | 5/2012 | Wilzbach et al. | |
| 8,684,855 | B2 | 4/2014 | Osterman et al. | |
| 8,795,096 | B2 | 8/2014 | Stoker | |
| 10,183,685 | B2 | 1/2019 | King et al. | |
| 2007/0089630 | A1 | 4/2007 | Gordon | |
| 2010/0062866 | A1 | 3/2010 | Schnuckle | |
| 2013/0145953 | A1 | 6/2013 | Crawford et al. | |
| 2013/0244801 | A1 | 9/2013 | Frolov | |
| 2013/0324271 | A1 | 12/2013 | Stoker | |

FOREIGN PATENT DOCUMENTS

| | | | |
|---|---|---|---|
| EP | 0534712 | A1 | 3/1993 |
| GB | 215238 | | 5/1924 |
| JP | H024399 | A | 1/1990 |
| RU | 2053574 | | 1/1996 |
| WO | 2015179298 | A1 | 11/2015 |

OTHER PUBLICATIONS

Notification Concerning Transmittal of International Preliminary Report on Patentability dated Apr. 12, 2018 in International Application No. PCT/US2016/05287.4.

RU 2018115732 Decision of Grant dated Oct. 30, 2018.

CN 201680070648.3 Office Action dated Jan. 25, 2019.

KR 2018-7012275 Notice of Allowance dated Dec. 7, 2018.

JP Office Action issued in JP Patent Application No. 2018-517148 dated Jan. 29, 2019 (1 page).

* cited by examiner

AMUSEMENT PARK RIDE TUNNEL

CROSS REFERENCE TO RELATED APPLICATIONS

This application is a continuation of U.S. Non-Provisional patent application Ser. No. 14/873,731, entitled "AMUSEMENT PARK RIDE TUNNEL" filed Oct. 2, 2015, which is hereby incorporated by reference in its entirety.

BACKGROUND

The present disclosure relates generally to amusement park-style rides, and more specifically to systems and methods for creating the illusion of speed.

Most amusement park-style rides include a ride vehicle that carries passengers along a ride path, for example a track. Over the course of the ride, the ride path may include a number of features, including tunnels, turns, ups, downs, loops, and so forth. Even though a an typical amusement park ride that includes a combination of these and other features may only last a few minutes, the amount of space required to build such a ride, and the cost associated with doing so, is significant. Accordingly, it is now recognized that it is desirable to reduce the footprint of a ride system without sacrificing the quality of the experience for a passenger.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In a first embodiment, a ride system includes a tunnel, a vehicle ride path in the tunnel, an entrance disposed at a first end of the tunnel, a second end of the tunnel, one or more walls of the tunnel, and a projection system to project images onto the one or more walls of the tunnel. The tunnel is curved such that the second end of the tunnel is not visible at an intermediate position between the first end of the tunnel and the second end of the tunnel.

In a second embodiment, an amusement park ride includes a set piece conveyance mechanism, a tunnel, and a ride path disposed within the tunnel. The tunnel has an entrance at a first end of the tunnel, a second end of the tunnel, and at least one wall. The ride path is within the tunnel and is bounded by the at least one wall of the tunnel and the set piece conveyance mechanism. The set piece conveyance mechanism moves set pieces along a length of the ride path. The tunnel is curved in shape such that the second end of the tunnel is not visible at an intermediate position along the ride path between the entrance and the second end.

In a third embodiment, a method includes receiving a ride vehicle through an entrance at a first end of a tunnel and projecting images on or moving set pieces along one or more walls of the tunnel to create an illusion of speed as the ride vehicle decelerates from the entrance to the intermediate position and while the ride vehicle is stationary at the intermediate position. The tunnel has a curved shape such that a second end of the tunnel is not visible from an intermediate position between the entrance and the second end along a ride path in the tunnel.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Typical amusement park ride systems (e.g., roller coasters or dark rides) include a ride vehicle that follows a ride path (e.g., a track) through a series of features. Such features may include tunnels, turns, ups, downs, loops, and the like. Even though amusement park ride systems may provide rides that only last a few minutes because the ride vehicles often travel at high speeds, the foot print of the ride path may be quite large. Accordingly, the costs associated with building an amusement park ride system and the space required to do so may be significant. Naturally, this is a more acute issue for an amusement park housing many ride systems within limited space.

By using the systems and techniques described herein to create the illusion of speed and/or directional transition for passengers in a slowly moving or stationary ride vehicle, the length of ride path covered by the ride vehicle, the footprint of the ride, and the cost to build the ride may be reduced. By reducing the footprint of one or more rides, an amusement park may be capable of having a larger number of ride systems, which may be generally referred to as rides, and the distance between rides that amusement park guest have to walk may be reduced, or the size of an amusement park having a set number of rides may be reduced.

Figure 1:
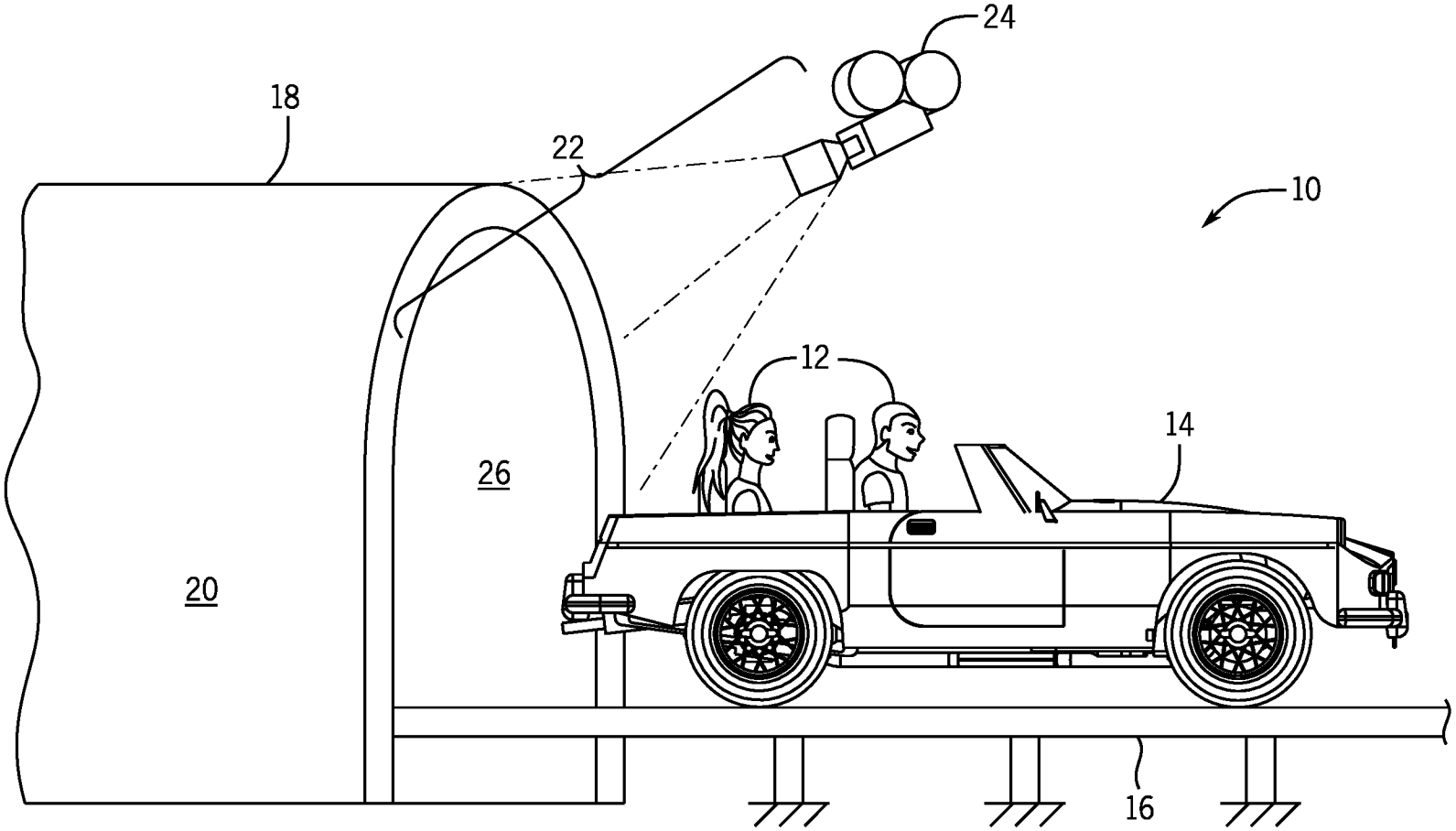
FIG. 1 is a side perspective view of a ride system in accordance with aspects of the present disclosure.

FIG. 1 shows one embodiment of a ride system 10. The ride system 10 may include a ride vehicle 14 that holds one or more passengers 12. In some embodiments, multiple ride vehicles 12 may be coupled together (e.g., by a linkage). The ride vehicle 14 travels along a ride path 16. The ride path 16 may be any surface on which the ride vehicle 14 travels. In some embodiments, the ride path 16 may be a track. The ride path 16 may or may not dictate the path traveled by the ride vehicle 14. That is, in some embodiments, the ride path 16 may control the movement (e.g., direction, speed, and/or orientation) of the ride vehicle 14 as it progresses, similar to a train on train tracks. In other embodiments, there may be a system for controlling the path taken by the ride vehicle 14. For example, the ride path 16 may be an open surface that allows the passengers 12 to control certain aspects of the movement of the ride vehicle 14 via a control system resident on the ride vehicle 14.

The ride system 10 may also include one or more tunnels 18, through which the ride vehicle 14 passes. The tunnels 18 may have one or more walls 20. The walls 20 may be rigid or flexible. For example, in some embodiments, the walls may be structural members, while in other embodiments, the walls may be decorative (e.g., a sheet of fabric held in place by a support structure. The walls 20 may be transparent, translucent, or opaque. The tunnels 18 may be features in and of themselves, or the tunnels 18 may be combined with other features. That is, one or more of the tunnels 18 may be combined with a turn, an up, a down, a loop, or some combination thereof. At least one of the tunnels 18 may be curved such that from an intermediate position within the tunnel 18, the end of the tunnel 18 may not be visible.

The ride system 10 includes a projection system 22, which may project images on surfaces throughout the ride (along the ride path 16). The projection system 22 may include one or more projectors 24, one or more self-illuminating panels 26, or other systems and/or devices for projecting images on surfaces visible from the ride vehicle 14. For example, the projection system 22 may be used to project images onto the walls 20 of a tunnel 18. This may be done by projecting images onto the walls 20 from within the tunnel 18, projecting images from outside the tunnel 18 onto transparent or translucent walls, as shown in FIG. 1, such that the images can be seen by a passenger 12 in the ride vehicle 14. In other embodiments, images may be displayed on the walls 20 of the tunnel using self-illuminating panels 26 (e.g., an LCD display, a plasma display, and the like). It should be understood, however, that these are merely examples and that the projection system 22 envisaged may include other ways to display images on surfaces visible from the ride vehicle 14. As will be described in more detail later, the projection system 22 may be used to project images on the walls 20 of a tunnel 18, or other surfaces visible from the ride vehicle 14, in order to create the illusion that the ride vehicle 14 is moving faster than it actually is, that the ride vehicle 14 is moving when it is actually stationary, or to create an illusion of, or hide, directional transition.

Figure 2:
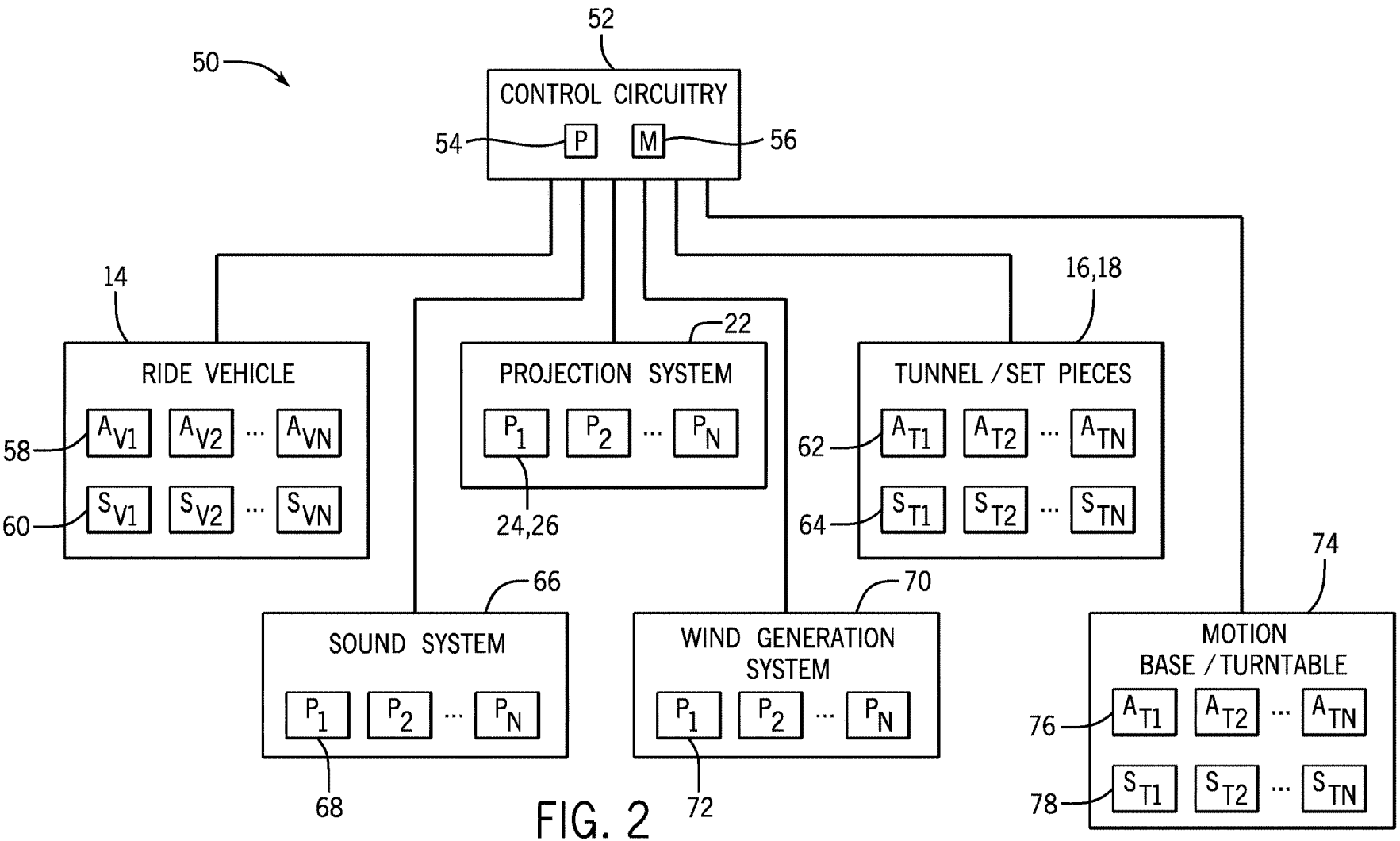
FIG. 2 is a schematic view of a control system for the ride system in accordance with aspects of the present disclosure.

FIG. 2 is a schematic of the control system 50 for the ride system 10. The control system 50 may include control circuitry 52 which may control and/or receive inputs from various components throughout the ride system 10. The control circuitry may include a processor 54 and a memory component 56. The processor 54 may be used to run programs, execute instructions, interpret input, generate control signals, and/or other similar functions. The memory component 56 may be used to store data, programs, instructions, and so forth.

The control circuitry 52 may be in communication with the ride vehicle 14, which may be equipped with one or more actuators 58 and/or one or more sensors 60. The actuators 58 on the ride vehicle 14 may control motion (move forward, move backward, turn, brake) of the ride vehicle 14, or other actuators (e.g., actuators for passenger 12 safety harnesses) on the ride vehicle 14. The actuators 58 may be controlled by a control signal output by the control circuitry 52. The sensors 60 may sense one or more parameters indicative of the position, tilt, velocity, acceleration, etc. of the ride vehicle 14.

The control circuitry 52 may also be in communication with the projection system 22. For example, based on the inputs from the sensors 60 on the ride vehicle 14, the control circuitry 52 may output images for each of the projectors 24 or self-illuminating panels 26 to project, or may instruct the projectors 24 or self-illuminating panels 26 which images to project. In some embodiments, the images may be stored in the memory component 56 of the control circuitry 52. In other embodiments, the projection system 22 or each projector 24 or self-illuminated panel 26 may store the images to be projected.

The control circuitry 52 may also be in communication with various actuators 62 and sensors 64 for the tunnel 18, the ride path 16, one or more set pieces, or other components within the ride system 10. The actuators 62 may be distributed throughout the tunnel 18, the ride path 16, one or more set pieces, or other components (e.g., a motion base, a turntable) within the ride system, giving the control circuitry 52 control over the movement of those objects. The sensors may be distributed throughout the same tunnel 18, the ride path 16, one or more set pieces, or other components within the ride system and configured to send signals to the control circuitry 52. The signals may be indicative of position, velocity, acceleration, operating conditions (e.g., temperature, pressure), and the like. The various actuators 58, 62, sensors 60, 64, and projection devices 24, 26 allow the control circuitry 52 to coordinate the various components of the ride system 10 in order to facilitate the illusion of speed to a passenger 12 in the ride vehicle 14.

The control circuitry 52 may also be in communication with a sound system 66, which may include one or more sound projection devices 68 (e.g., speakers, subwoofers, etc.) The sound system 66 may be used in conjunction with the projection system 22 to create the illusion of speed by projecting sounds that may or may not correspond to the images projected by the projection system 22. Similarly, the control circuitry 52 may be in communication with a wind generation system 70, which may include one or more wind generating devices 72 (e.g., fans, blowers, etc.). The wind generation system 70 may be used to create airflow to simulate wind (steady wind, gusts of wind, etc.) to further enhance the illusion of speed.

In some embodiments, the ride system 10 may include a motion base and/or turntable 74, which may include a number of actuators 76 and sensors 78. The motion base may be used to tilt, vibrate, rotate, or move the ride vehicle 14 in some other way. As will be discussed in more detail later, these movements may be used to enhance the illusion of speed.

Figure 3:
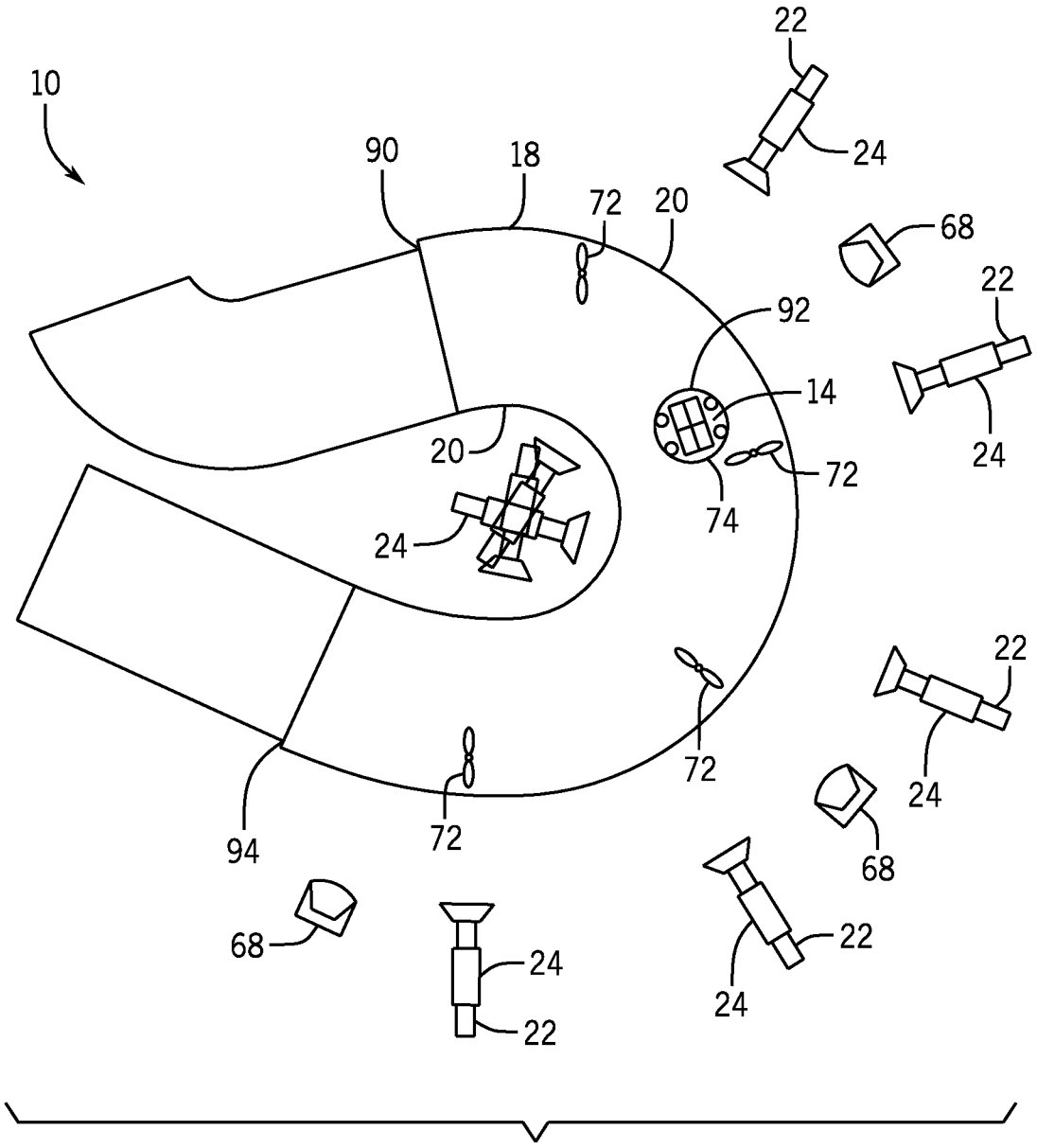
FIG. 3 is an overhead schematic view of the ride system with a vanishing point tunnel in a pass-through tunnel configuration in accordance with aspects of the present disclosure.

FIG. 3 is an overhead schematic representation of one embodiment of the ride system 10 with a pass-through tunnel 18 configuration. The ride vehicle 14 enters the tunnel 18 at a first end 90 and decelerates as the ride vehicle 14 approaches an intermediate position 92 within the tunnel 18. In some embodiments there may be multiple intermediate positions 92. As the ride vehicle 14 proceeds through the tunnel 18, a number of projectors 24 project images on the walls 20 such that the passenger 12 is encouraged to perceive that the ride vehicle 14 is not decelerating. For example, in one embodiment, the images projected on the walls 20 may accelerate (e.g., provide moving images that appear to correspond to acceleration of the ride vehicle 14 with respect to the images) at the same rate that the ride vehicle 14 decelerates in order to create the illusion of constant velocity. In another embodiment, the images projected on the walls 20 may accelerate at a rate greater than the rate at which the ride vehicle 14 decelerates, creating the illusion of acceleration. In yet another embodiment, the images projected onto the walls 20 may not create the illusion of acceleration or constant velocity, but rather may disorient the passenger 12 such that the passenger is unaware of the ride vehicle's deceleration. The projection system 22 in the embodiment shown in FIG. 3 includes a number a projectors 24 disposed outside of the tunnel 18. In such an embodiment, the walls 20 would be translucent or transparent such that a passenger 12 in the ride vehicle 14 would be able to see the images on the walls 20 from the inside of the tunnel 18. It should understood, however, that a similar illusion may be created using a projection system 22 having a number of projectors 24, self-illuminating panels 26, or other projection devices located inside the tunnel 18, outside the tunnel 18, or both. Additionally, in some embodiments, a sound system 66 having a number of speakers 68, may project sound and/or a wind generation system 70, having a number of fans 72 may generate airflow to similar wind, in some cases working in conjunction with the projection system 22 to create the illusion of speed.

In one embodiment, the ride vehicle 14 comes to a stop at an intermediate position 92. As previously mentioned, there may be more than one intermediate position 92 within the tunnel 18. The intermediate position 92 may be any location or area within the tunnel at which a passenger 12 in the ride vehicle 14 is unable to see the first end 90 and/or second end 94 of the tunnel 18 (e.g., the ends 90 and 94 are beyond the visual horizon from the perspective of the passenger 12). As the ride vehicle 14 comes to a stop and remains stationary at the intermediate position 92, the projection system 22 projects images on the walls 20 of the tunnel 18 that create an illusion of motion for the passenger 12, even though the ride vehicle is not moving, such that the passenger 12 does not perceive that the ride vehicle 14 has stopped. The images projected on the walls 20 may create the illusion of constant velocity, increasing velocity, decreasing velocity, or a combination thereof. For example, though the walls 20 may be a smooth surface, the projection system may project a moving brick, stone, or other textured surface on the walls 20 in order to create the illusion of speed. The images may also include stationary features in a hypothetical tunnel, such as support beams, and the like to further make the illusion of speed more realistic. In some embodiments, the ride path 16 and corresponding hardware may be covered or otherwise obstructed from the passenger's 12 view, and in some cases projected upon by the projection system 22 to make the illusion more realistic.

In some embodiments, the intermediate position 92 may be atop a motion base 74 or other moving platform, which may be capable of tilting and or vibrating the ride vehicle 14 to enhance the illusion of speed. The wind generation system 70 may blow air at passengers 12 in the ride vehicle 14 as the ride vehicle 14 progresses through the tunnel 18 or sits stationary at the intermediate position 92. The air blown at passengers 12 by the wind generation system 70 may further enhance the illusion of speed by simulating the feel of moving through air at high speeds.

As discussed with regard to FIG. 2, the ride vehicle 14, the projection system 22, the motion base 74, the wind generation system 70, the sound system 66, and any other components may be under the control of the control system 50. For example, based upon input (e.g., the position of the ride vehicle 14, the velocity of the ride vehicle 14) from sensors 60 on the ride vehicle 14 and sensors 64 disposed elsewhere throughout the system 10, the control system 50 may control actuators 28 on the ride vehicle 14, the images projected by the projection system 22, actuators 62 on the motion base, actuators 62 within the wind generation system 70, and so forth. In other embodiments, the ride system 10 may lack a control system 52, such that the ride system 10 is a "push-play" system which performs the same sequence of repeatable steps, with no feedback loop, each time an operator starts the system 10.

After a period of time during which the ride vehicle 14 is stationary or moving slowly along the ride path 16 (e.g., not including movement of any motion base 74) at or within the intermediate position, the ride vehicle 14 begins to accelerate away from the intermediate position 92. During this time, the projection system 22 may project images onto the walls 20 of the tunnel 18 such that the passenger 12 is discouraged from perceiving that the ride vehicle 14 is accelerating from a stop. For example, the images projected by the projection system 22 may decelerate (e.g., provide moving images that correspond to deceleration of the ride vehicle 14 from the perspective of the passenger 12) at the same rate at which the ride vehicle 14 accelerates to create the illusion to the passenger 12 of constant speed. In some embodiments of the ride system 10, the projection system 22 may accelerate and decelerate the projected images opposite the accelerations and decelerations of the ride vehicle 14 such that the passenger 12 perceives that the ride vehicle 14 is moving at a constant speed while it is in the tunnel 18. In other embodiments, the images projected by the projection system 22 may accelerate and decelerate at different rates than the ride vehicle 14 in order to disorient the passenger. Furthermore, the projection system 22 may use flashes of light, darkness, loud sounds, and other projected images to disorient the passenger 12.

As the ride vehicle 14 accelerates away from the intermediate position 92, the ride vehicle proceeds toward the second end 94 of the tunnel 18, where the ride vehicle 14 exits the tunnel 18. Upon exiting the tunnel 18, the ride vehicle 14 may proceed to the remainder of the ride, which may include another similar tunnel 18, or any other combination of features.

Figure 4:
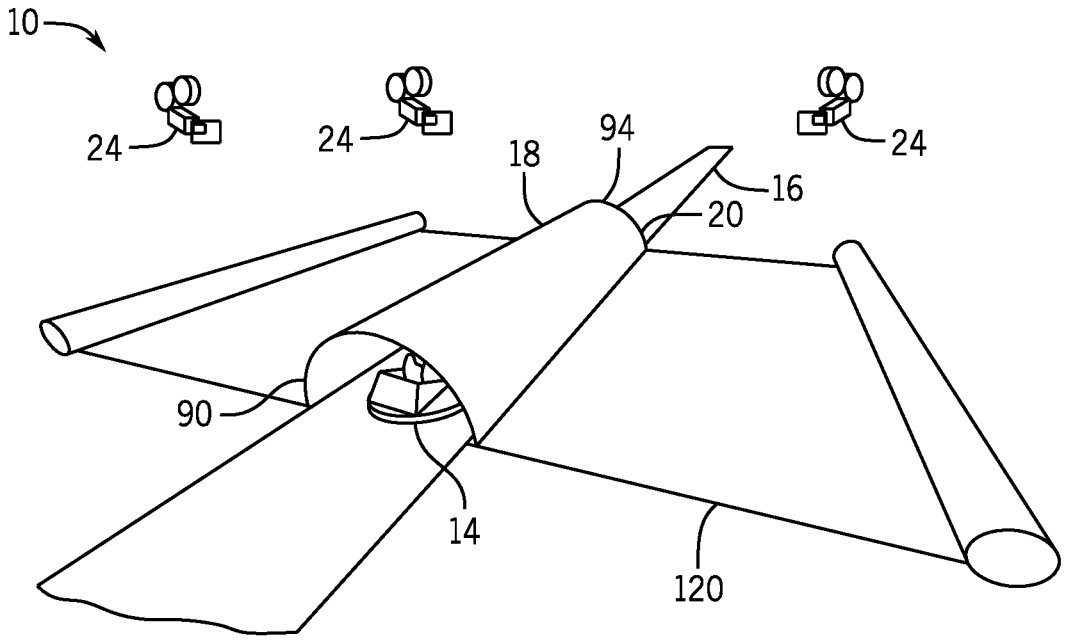
FIG. 4 is a perspective view of a flexible tunnel in a straight configuration, wherein one end of the flexible tunnel is configured to disconnect from the track or perceived ride path after the ride vehicle has entered the tunnel in accordance with aspects of the present disclosure.
Figure 5:
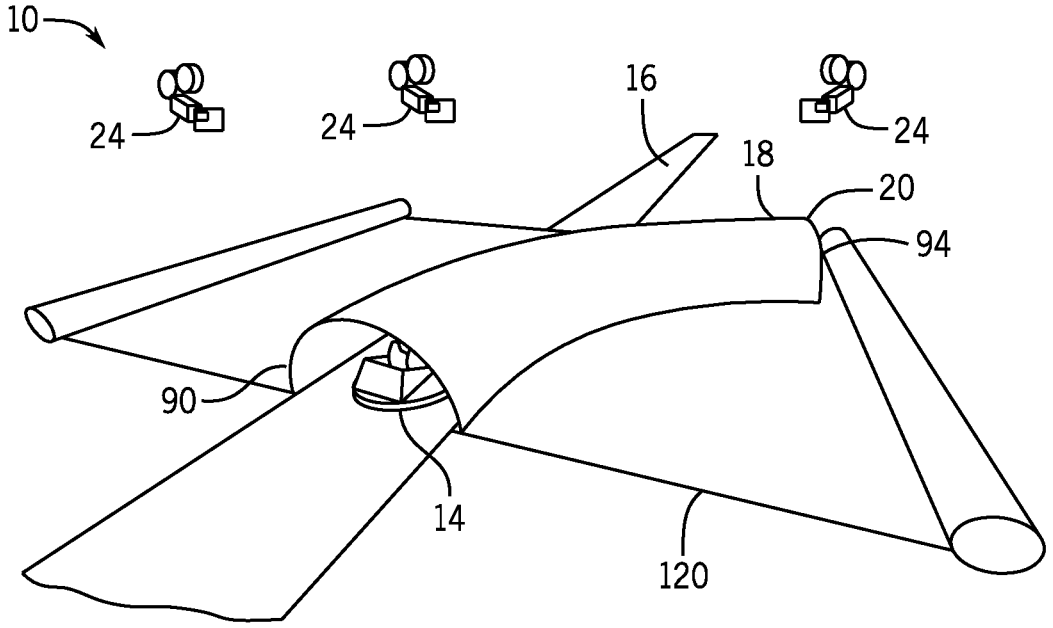
FIG. 5 is a perspective view of the flexible tunnel in which the flexible tunnel is orientated to simulate a right turn in accordance with aspects of the present disclosure.

FIGS. 4, 5, 6, and 7 include perspective views of an embodiment of the system 10 in which the second end 94 of the tunnel 18 is configured to be maneuvered into different orientations, which may include disconnection from the ride path 16. As shown in FIG. 4, the ride vehicle 14 enters the tunnel 18 through the first end 90. The ride vehicle 14 decelerates as it approaches an intermediate position 92. As with the embodiment shown in FIG. 3, the projection system 22 may project images onto the walls 20 of the tunnel as the ride vehicle 14 approaches the intermediate position 92 in order to create the illusion of speed. At some point, either before or after the ride vehicle 14 comes to rest at the intermediate position 92, the second end 94 of the tunnel 18 may disconnect from the ride path 16 (FIG. 5) such that a second end 94 of the tunnel 18 may not be visible to the passenger 12. In some embodiments, the tunnel may be disposed upon a tunnel platform 120. One or more actuators 62 may be used to control movement of the tunnel. Additionally, one or more sensors 64 may be disposed throughout the tunnel 18 or tunnel platform 120 to monitor its operation.

Figure 6:
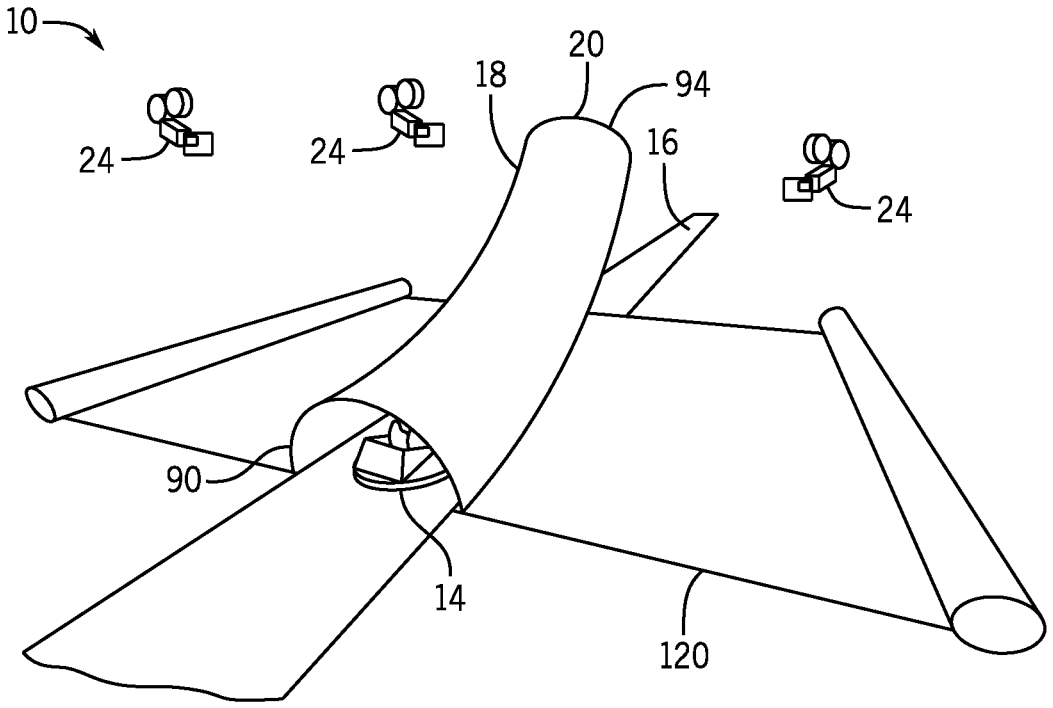
FIG. 6 is a perspective view of the flexible tunnel in which the flexible tunnel is oriented to simulate an upward slope in accordance with aspects of the present disclosure.
Figure 7:
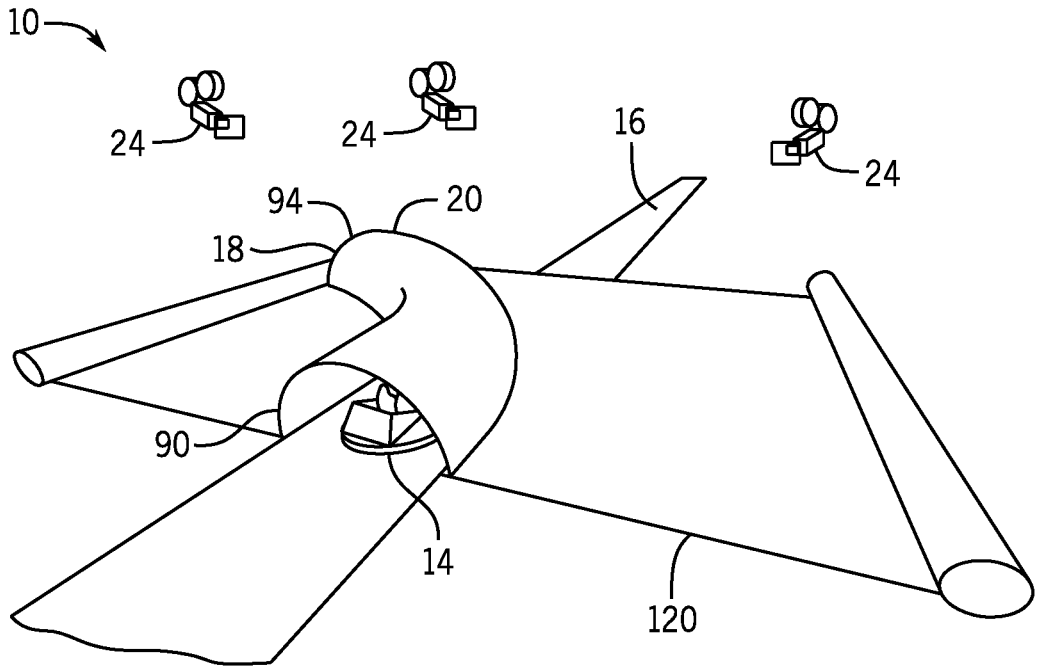
FIG. 7 is a perspective view of the flexible tunnel in which the flexible tunnel is oriented to simulate a left turn in accordance with aspects of the present disclosure.

As with the embodiment shown in FIG. 3, when the ride vehicle stops or slows at the intermediate position 92, the projection system 22 may project images on the walls 20 of the tunnel to create the illusion of speed. The system 10 may include a motion base 74, a tilting platform, a wind generation system 70, a sound system 66, and the like in order to enhance the illusion of speed. However, in the embodiment shown in FIGS. 4-7, the ride system 10 has the capability to simulate turns in either direction, as well as ups, down, and combinations thereof. For example, FIG. 6 shows an embodiment of the system 10 wherein the second end 94 of the tunnel 18 is tilted up to simulate an upward slope. Similar methods could be used to simulate a downward slope. Similarly FIG. 7 shows that the system 10 may be capable of simulating turns to both the right and left. By having the capability to simulate speed through right turns, left turns, upward slopes, downward slopes, and combinations thereof, the ride system 10 may be capable creating the illusion of speed for passengers 12 in the ride vehicle 14 for longer periods of time than a similar system 10 that simulates a single turn. The moving platform (e.g., motion base) 74 may facilitate simulation of actual speed and directional changes by moving in coordination with changes to the tunnel configuration. For example, in the orientation illustrated in FIG. 4, movement of the motion base 74 may simulate the forces associated with moving up a steep slope. Similarly, movement of the motion base 74 may simulate forces associated with different types of turns and direction changes in coordination with corresponding orientation changes of the tunnel 18.

After a period of time during which the ride vehicle 14 is stationary or moving slowly along the ride path 16 at the intermediate position 92, the ride vehicle 14 may operate to accelerate away from the intermediate position 92. At some point before the ride vehicle 14 exits the tunnel 18, the second end 94 of the tunnel may orient into a position that facilitates passage of the vehicle 14 (e.g., by reconnecting with an aspect of the ride path 16). During this time, the projection system 22 may project images onto the walls 20 of the tunnel 18 such that the passenger 12 is encouraged to not perceive that the ride vehicle 14 is accelerating from a stopped or slowed state. For example, the projection system 22 may accelerate and decelerate the projected images opposite the accelerations and decelerations of the ride vehicle 14 such that the passenger 12 perceives that the ride vehicle 14 is moving at a constant speed while it is in the tunnel 18. In other embodiments, the images projected by the projection system 22 may accelerate and decelerate at different rates than the ride vehicle 14 in order to disorient the passenger. As shown in FIGS. 4-7, the projection system 22 may project onto the ride path 16 (e.g., projected lane lines) to further enhance the illusion of speed. Furthermore, the projection system 22 may use flashes of light, darkness, and other projected images to disorient the passenger 12.

As the ride vehicle 14 accelerates away from the intermediate position 92, the ride vehicle proceeds toward the second end 94 of the tunnel 18, where the ride vehicle 14 exits the tunnel 18. Upon exiting the tunnel 18, the ride vehicle 14 may proceed on the ride path 16 through the remainder of the ride, which may include another similar tunnel 18, or any other combination of features.

Figure 8:
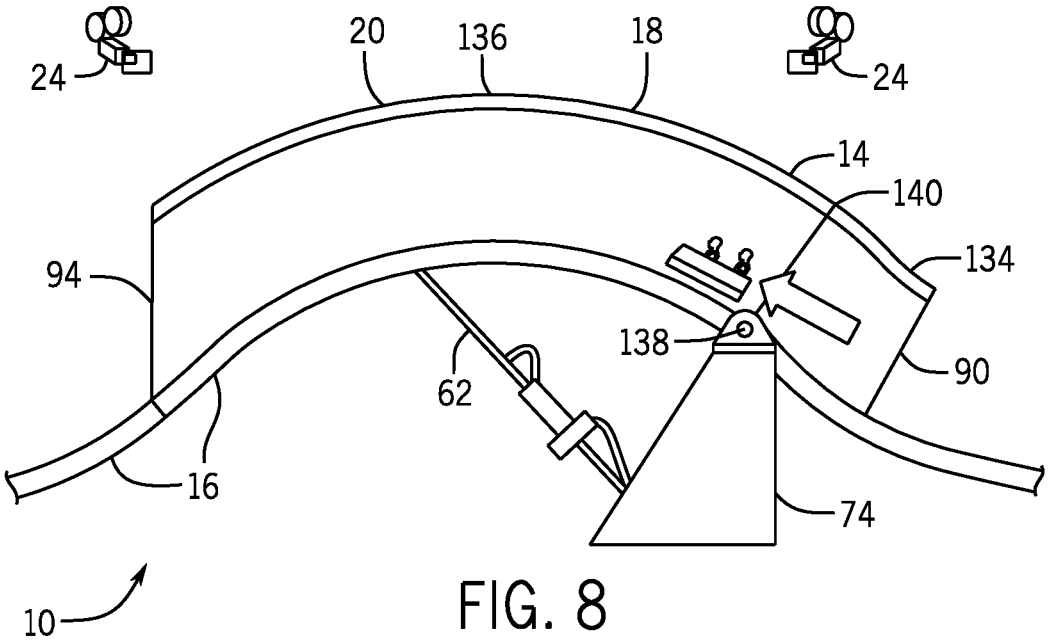
FIG. 8 is a schematic cross-sectional view of a rigid tunnel system in which at least one end of a rigid tunnel is configured to disconnect from the track after the ride vehicle has entered the tunnel in accordance with aspects of the present disclosure.
Figure 9:
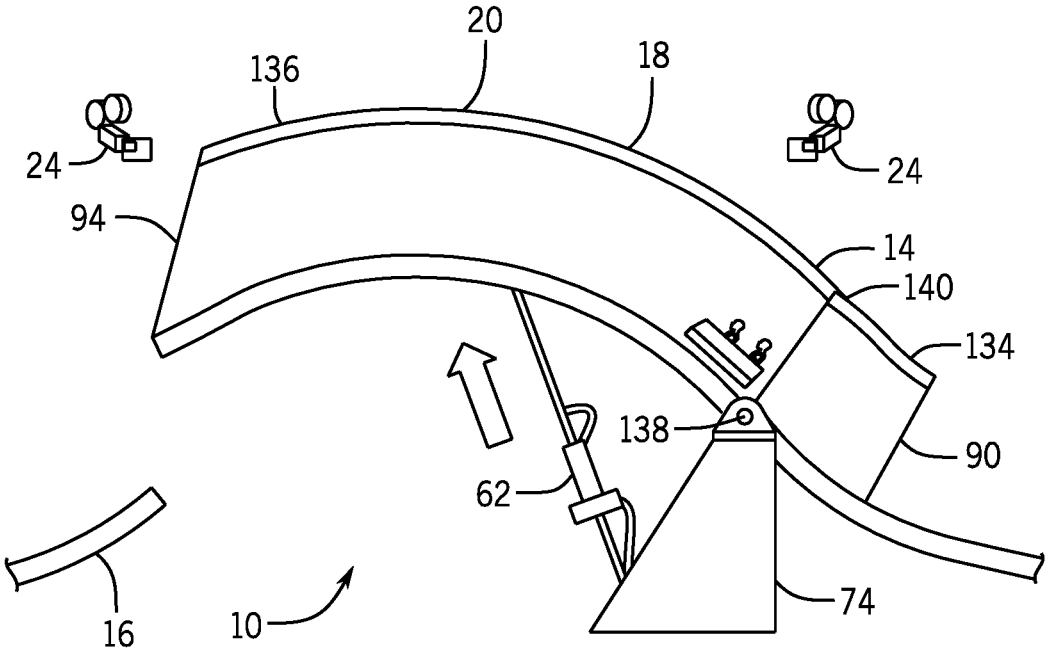
FIG. 9 is a schematic cross-sectional view of the rigid tunnel system arranged to simulate an upward slope in accordance with aspects of the present disclosure.
Figure 10:
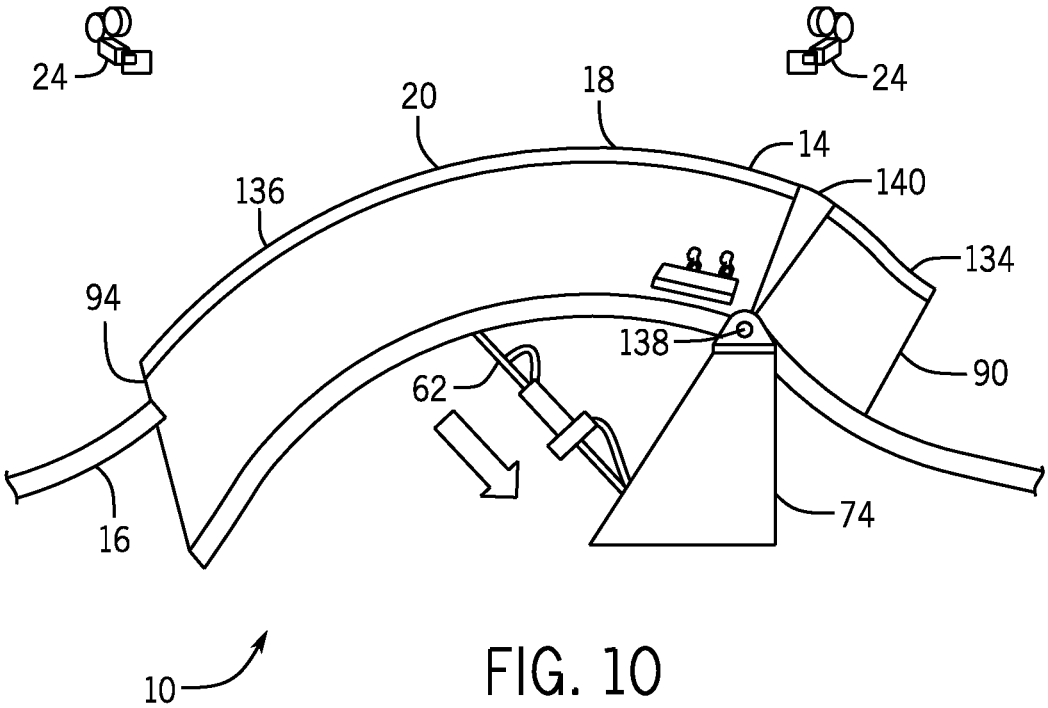
FIG. 10 is a schematic cross-sectional view of the rigid tunnel system arranged to simulate an downward slope in accordance with aspects of the present disclosure.

FIGS. 8, 9, and 10 show another embodiment of the ride system 10 in which the second end 94 of the tunnel 18 disconnects from the ride path 16. As with the embodiment shown in FIGS. 4-7, the ride vehicle 14 enters the tunnel 18 through a first end 90 and decelerates as the ride vehicle 14 approaches an intermediate position 92. The projection system 22 projects images on the walls 20 of the tunnel 18 to create the illusion of speed as the ride vehicle approaches the intermediate position 92. At some point before or after the ride vehicle 14 comes to rest or slows at the intermediate position 92, the second end 94 of the tunnel 18 disconnects from the ride path 16. In the embodiment shown in FIGS.

8-10, the tunnel 18 may be disposed upon a motion base 74. The motion base may include actuators 62 and/or sensors 64 to facilitate movement of the tunnel 18. Whereas the bottom of the tunnel 18 shown in FIGS. 4-7 may be flexible, the bottom of the tunnel 18 in FIGS. 8-10 may be rigid. Accordingly, the rigid sections 134, 136 of the tunnel may be connected by a hinge 138 and a flexible joint 140 that accounts for a gap between sections 136. For example, the flexible joint may be one or more flexible pieces of fabric that cover a gap between tunnel sections 134, 136. In another embodiment, the flexible joint 140 may include one or more sets of telescoping panels that move relative to one another as tunnel section 136 tilts up and down. In yet another embodiment, the flexible joint 140 may include bellows, or some other flexible structure to account changes in spacing between the tunnel sections 136, 134. In some embodiments, the tilting tunnel section 136 may be actuated by the motion base 74. In other embodiments, the tunnel may be actuated by an actuator 62 (e.g., a linear actuator). While the ride vehicle 14 is stationary, the tunnel may tilt upward (FIG. 9) and downward (FIG. 10) in order to simulate the illusion of speed over ups and downs in the ride path 16. In some embodiments, the illusion of upward and/or downward speed shown in FIGS. 8, 9, and 10 may be used to make the passenger perceive that the ride spends more time going down than it does going up, even though the ride may have a net-zero elevation gain.

As with the other embodiments discussed, after a period of time at which the ride vehicle 14 is stationary or in a slowed state at the intermediate position within the tunnel 18, the ride vehicle 14 begins to accelerate away from the intermediate position and proceed through the tunnel. At some point before the ride vehicle 14 exits the tunnel 18, the second end 94 of the tunnel reconnects with the ride path 16. As the ride vehicle 14 proceeds, the projection system 22 projects images onto the walls 20 of the tunnel 18 that maintain the illusion of speed. The images projected by the projection system 22 may decelerate at the same rate at which the ride vehicle 14 accelerates to create the illusion of constant velocity or the projected images may appear to accelerate and decelerate at rates different from the accelerations and decelerations of the ride vehicle 14 to disorient the passenger. The projection system 22 may also use flashes of light, darkness, and other projected images to further create the illusion of speed or disorient the passenger 12.

Figure 11:
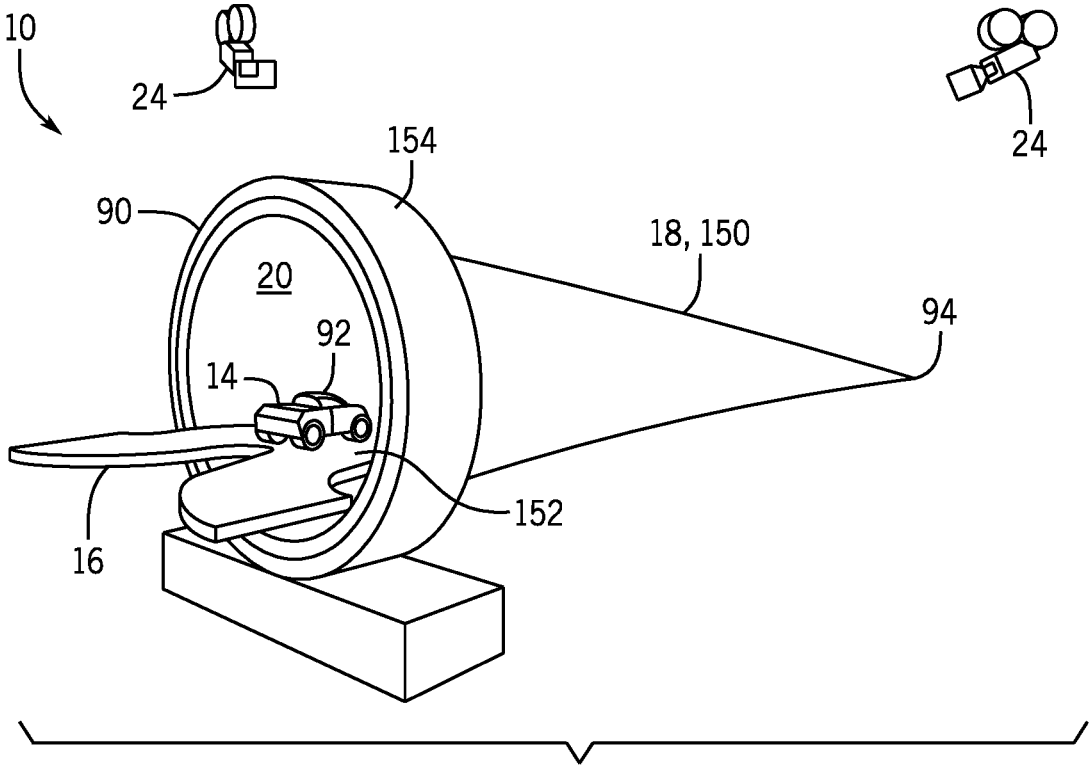
FIG. 11 is a perspective view of a decreasing cross-section tunnel in which the decreasing cross-section tunnel is oriented to simulate a right turn in accordance with aspects of the present disclosure.
Figure 12:
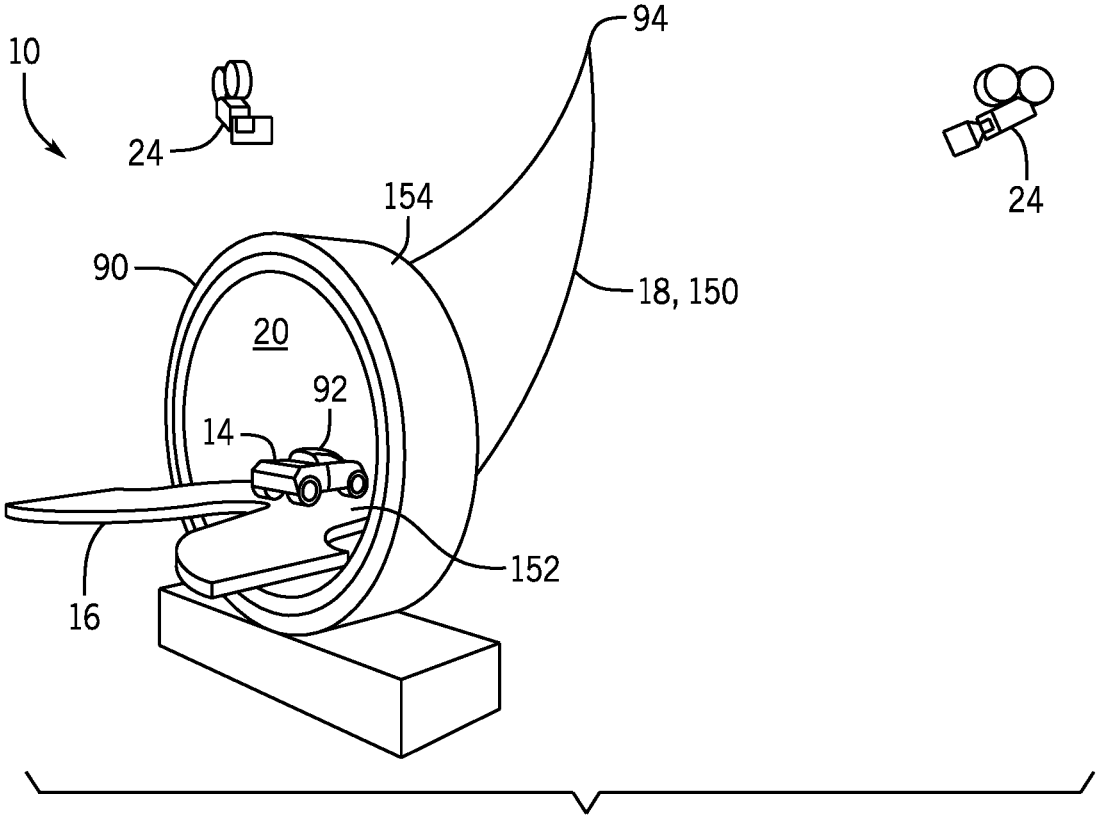
FIG. 12 is a perspective view of the decreasing cross-section tunnel in which the decreasing cross-section tunnel is oriented to simulate an upward trajectory in accordance with aspects of the present disclosure.
Figure 13:
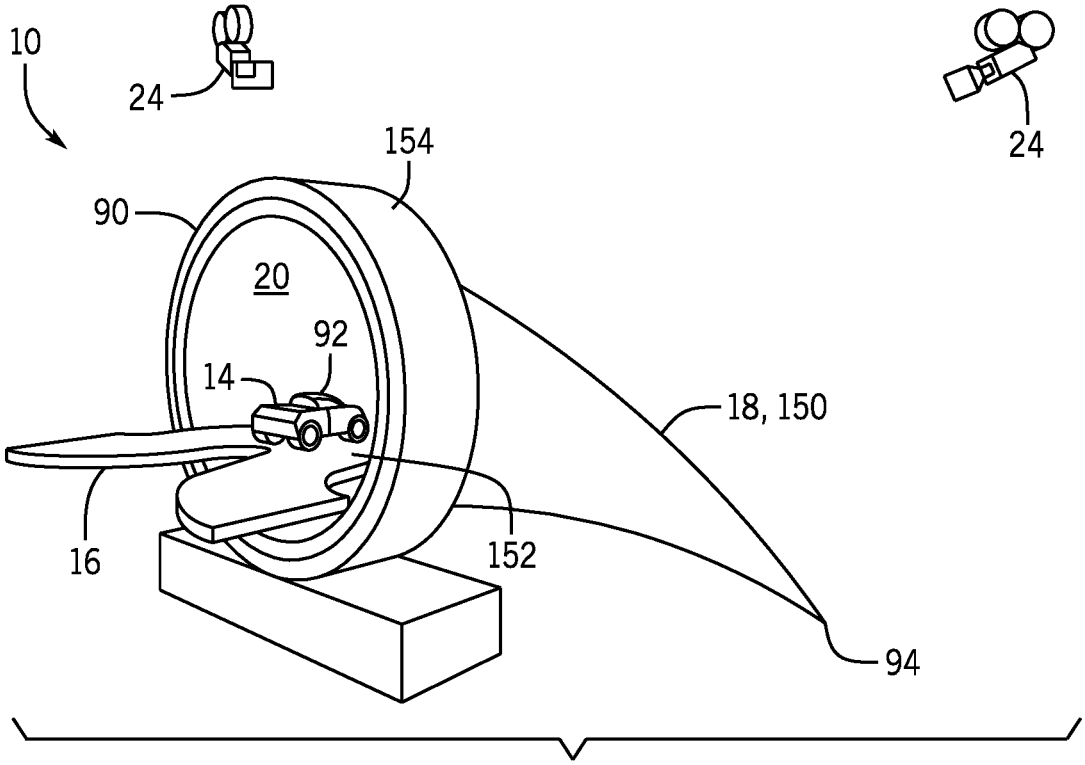
FIG. 13 is a perspective view of the decreasing cross-section tunnel in which the decreasing cross-section tunnel is oriented to simulate a downward trajectory in accordance with aspects of the present disclosure.

FIGS. 11, 12, and 13 show an embodiment of the ride system 10 in which the ride vehicle 14 enters and exits through the same end 90 of the tunnel 18, rather than traveling through the tunnel 18. In some embodiment, the tunnel 18 may not be a tunnel in the classical sense (i.e., having an entrance and an exit, through which the ride vehicle 14 passes), but instead be a faux-tunnel 150 having an entrance, but no exit. In the embodiment shown in FIGS. 11-13, the cross-sectional area of the tunnel 18 decreases from the first end 90 to the second end 94 in a conical or cornucopia shaped fashion. In some embodiments, the tunnel 18 may come to a point at the second end 94. In other embodiments, the second end 94 of the tunnel 18 may be open, but smaller than the opening at the first end 90 of the tunnel 18. Such an embodiment may create an illusion that the tunnel 18 is longer than it really is. In yet other embodiments, the second end 94 of the tunnel 18 may have the same cross-sectional areas as the first end 90. As is shown in FIGS. 11-13, the direction the tunnel 18 curves may be used to simulate ups, downs, and curves. As with previously discussed embodiments, the tunnel 18 may be flexible (e.g., fabric over a skeleton support structure), allowing it to bend in various directions, or the tunnel 18 may be rigid, and then rotate about the first end 90 to simulate changes in direction.

The ride vehicle 14 enters the tunnel 18 through a first end 90 and proceeds to an intermediate position 92. As the ride vehicle 14 proceeds toward the intermediate position 92, the projection system 22 projects images on the walls 20 of the tunnel 18 that create the illusion of speed. For example, the images projected on the walls 20 may create the illusion of constant velocity, increasing velocity, decreasing velocity, or a combination thereof.

As the ride vehicle 14 decelerates in its approach to the intermediate position 92, the projection system 22 may project images into the walls 20 of the tunnel 18 to create the illusion of movement, even though the ride vehicle 14 may be stationary, slowed, or coming to a stop at the intermediate position 92. As previously discussed, the intermediate position may be atop a motion base 74. The intermediate position 92 may also be atop a turntable 152. While the ride vehicle 14 remains stationary or slowed at or within the intermediate position 92, the one or more tunnel actuators 62 may move the second end 94 of the tunnel 18, varying the curvature and/or direction of the tunnel 18 to simulate ups, downs, turns, or some combination thereof. In such an embodiment, the tunnel 18 may be made of a flexible material (e.g., flexible cloth draped over a support structure) to accommodate a stationary first end 90 and a mobile second end 94. In other embodiments, the tunnel 18 may be rigid and be configured to rotate about a bearing 154 (e.g. a ball bearing or some other rotational interface) at the opening at the first end 90 of the tunnel 18, such that in a first position (FIG. 11), the tunnel simulates a right turn, in a second position (FIG. 12), the tunnel simulates an upward trajectory, in a third position (FIG. 13), the tunnel simulates a downward trajectory, and in a fourth position (not shown), the tunnel simulates a left turn. As previously discussed, the images projected by the projection system 22 may create the illusion of a constant velocity, or may create the illusion of rates of acceleration that vary wildly to disorient the passenger 12. Additionally, the ride system 10 may use a motion base 74, a wind generation system 70, a sound system 66, or other systems to further enhance the illusion of speed.

After a period of time, the ride vehicle 14 turns around, accelerates away from the intermediate position 92, and exits the tunnel 18 through the first end 90. The ride vehicle 14 may be turned around by a turn-table, the ride vehicle 14 itself may have a mechanism for turning the passengers around, or the ride path 16 may include a 180 degree turn disposed within the tunnel 18 (shown in FIGS. 11-13). The ride system 10 may use darkness or bright flashes of light from the projection system in order to disorient the passenger 12 as the ride vehicle 14 turns around and exits the tunnel 18, such that the passenger 12 is unaware that the ride vehicle 14 has turned around or otherwise changed directions. Upon exiting the tunnel 18, the ride vehicle may proceed to the remainder of the ride, which may include another similar tunnel 18, or any other combination of features.

Figure 14:
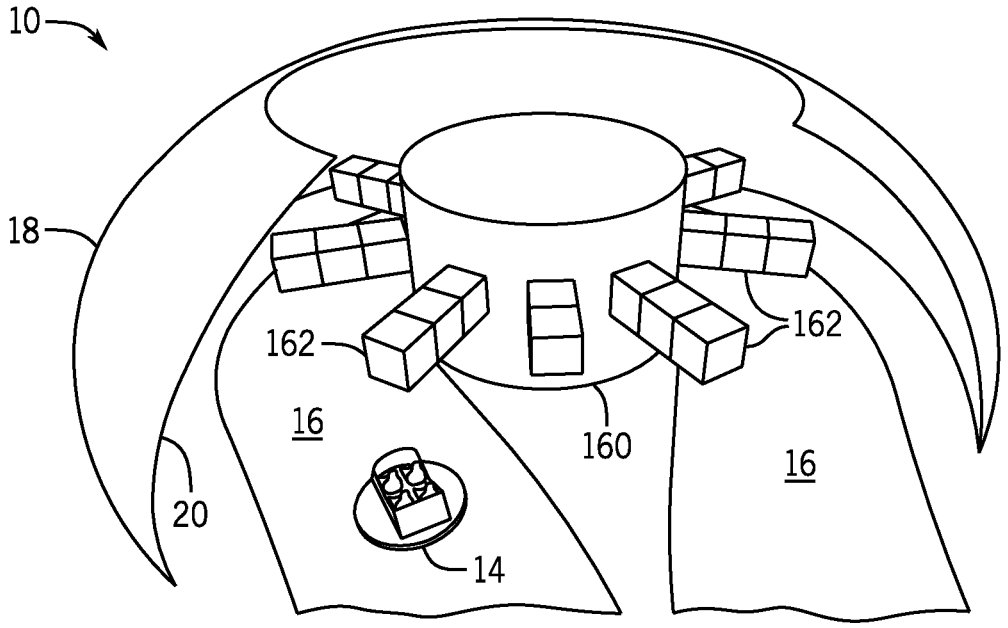
FIG. 14 is a perspective view of a ride vehicle entering an embodiment of the tunnel having a spinning carousel in accordance with aspects of the present disclosure.
Figure 15:
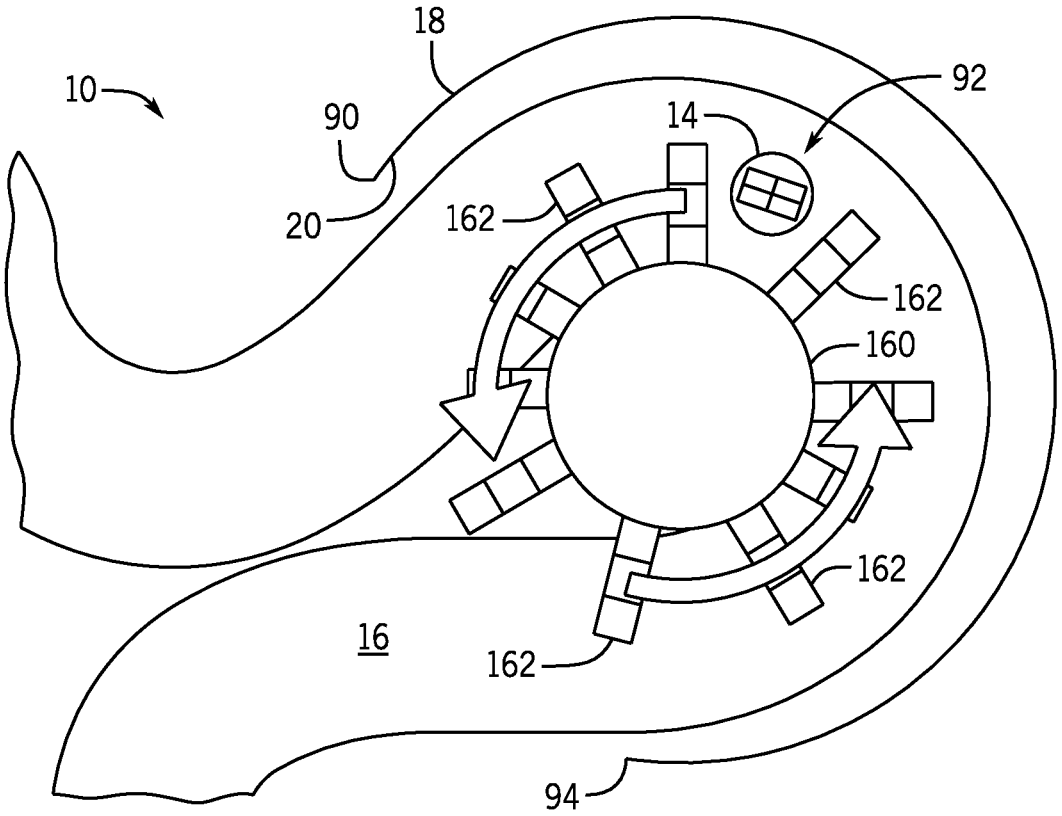
FIG. 15 is an overhead schematic view of the ride vehicle at an intermediate position inside an embodiment of the tunnel having a spinning carousel in accordance with aspects of the present disclosure.
Figure 16:
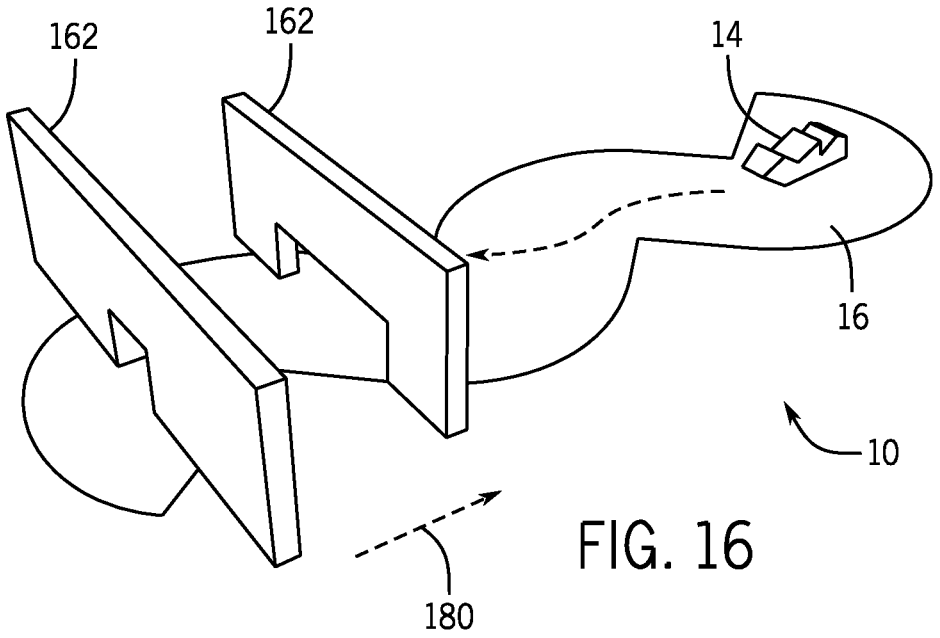
FIG. 16 is a perspective view of a ride vehicle entering an embodiment of the tunnel having laterally moving set pieces in accordance with aspects of the present disclosure.
Figure 17:
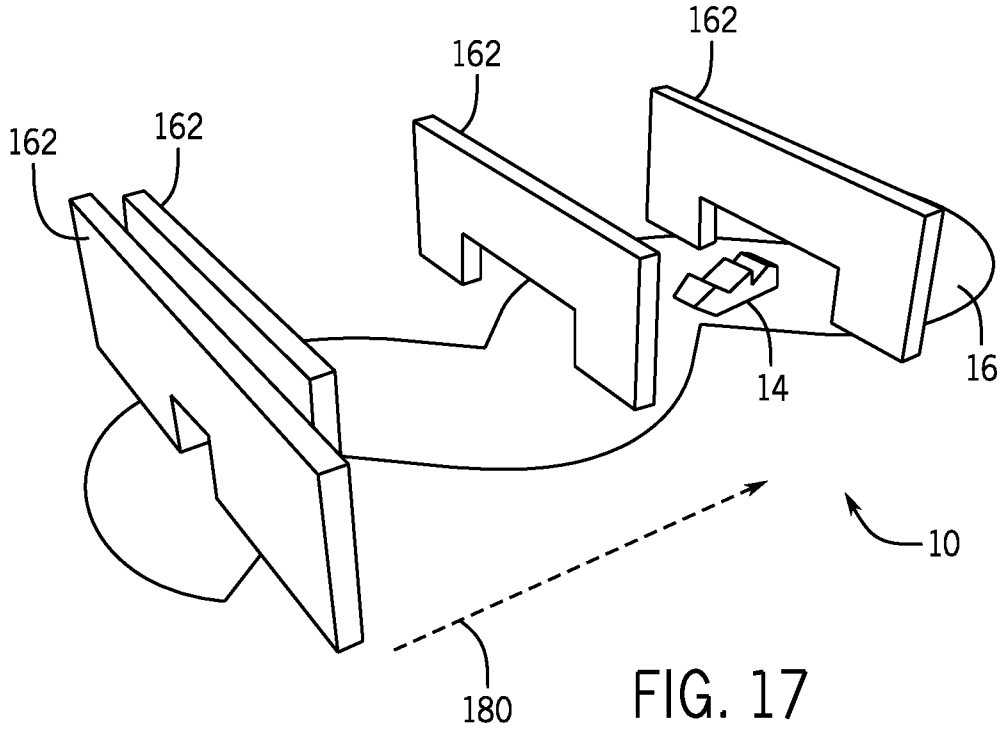
FIG. 17 is a perspective view of the set pieces moving toward a ride vehicle in an embodiment of the tunnel having laterally moving set pieces in accordance with aspects of the present disclosure.
Figure 18:
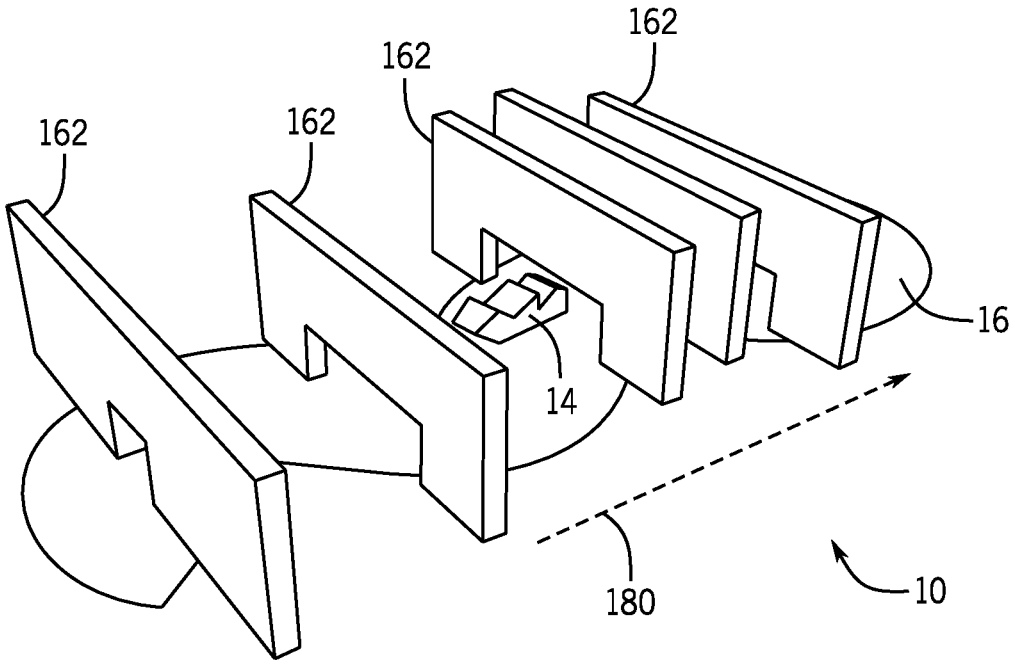
FIG. 18 is a perspective view of set pieces moving past a ride vehicle in an embodiment of the tunnel having laterally moving set pieces in accordance with aspects of the present disclosure.

FIGS. 14 and 15 show an embodiment of the ride system 10 having set pieces mounted to a carousel on the inside of a turn. In the embodiment shown in FIGS. 14 and 15, the tunnel 18 may be disposed about a turn in the ride path 16. Unlike previously depicted embodiments, the tunnel 18 only has a wall on the outside of the turn. However, in some embodiments, the tunnel 18 may have walls 20 on both the inside and the outside of the turn at the entrance (e.g. the first end 90) and/or at the exit (e.g., the second end 94) of the tunnel 18. The carousel 160, which may include one or more actuators 62 and/or sensors 64 under the control of the control system 52, may enhance the illusion of speed by providing surfaces or objects (e.g., set pieces 162) that move relative to the ride vehicle 14. In some embodiments, a number of set pieces 162 or other objects may be attached to the carousel 160. For example, the set pieces 162 may include beams, arches, or other objects that travel by, over, or around the ride vehicle 14 as the carousel 160 spins.

As with previously discussed embodiments, the ride vehicle 14 enters the tunnel 18 through a first end 90 and proceeds to an intermediate position 92. The ride vehicle 14 decelerates as it approaches the intermediate position 92. As the ride vehicle 14 approaches the intermediate position 92, the ride system 10 creates the illusion of speed. For example, the images projected by the projection system 22 and the carousel 160 may accelerate as the ride vehicle 14 decelerates. The acceleration of the images and carousel 160 may be equal and opposite the deceleration of the ride vehicle 14 to create the illusion of constant velocity. In other embodiments, the images and the carousel 160 may accelerate faster than the ride vehicle accelerates in order to create the illusion of acceleration. Various other combinations may be possible. As the ride vehicle 14 approaches the intermediate position 92, the various other systems under the control of the control system 50 (e.g., wind generation system 70, sound system 66, motion base 74, ride vehicle actuators 58 and sensors 60, tunnel actuators 62 and sensors 64) may assist in creating the illusion of speed.

The ride vehicle 14 may then come to rest or slow at an intermediate position 92, at which the passenger's view of the first end 90 and the second end 94 of the tunnel 18 are obstructed. The ride vehicle 14 may remain stationary or slowed at the intermediate position 92 for a period of time. During this time, the ride system 10, under the control of the control system 50, creates the illusion of speed. For example, the projection system 22 may project moving images on the walls 20 of the tunnel 18 that create the illusion of speed. The carousel 160 may spin, either at a constant speed or at varying speeds, such that one or more surfaces, objects, or set pieces 162 pass over, by, or around the ride vehicle 14. As with other embodiments, the intermediate position 92 may be atop a motion based that tilts or vibrates the ride vehicle 14. A wind generation system 70 (e.g., one or more fans 72) may enhance the illusion of speed by blowing air on the passenger 12. Additionally, the sound system 66 may play noises that make it sound as though the ride vehicle 14 is moving.

After a period of time at which the ride vehicle 14 is stationary or in a slowed state, the ride vehicle 14 may accelerate away from the intermediate position 92 and proceed through the tunnel 18 to the second end 94 of the tunnel. As the ride vehicle 14 proceeds to the second end of the tunnel, the ride system 10 continues to create the illusion of speed. The illusion may be created by the projection system 22, the sound system 66, the wind generation system 70, a motion base, or any number of actuators disposed throughout the ride system 10. In some embodiments, the various systems may be under the control of the control system 50, which controls the various systems based on input from sensors on the ride vehicle 60, sensors in the tunnel 64, or sensors disposed elsewhere throughout the system 10. In other embodiments, the system 10 may be a "push-play" system, wherein the ride operator pushes a start button and the ride system goes through the same series of steps in the same fashion over and over again. In some embodiments, for example, the images projected by the projection system 22 and the carousel 160 may decelerate as the ride vehicle 14 accelerates away from the intermediate position 92 so as to create the illusion of constant speed while the ride vehicle 14 is in the tunnel 18. In some embodiments, the carousel 160 and the images projected by the projection system 22 may stop moving by the time the ride vehicle 14 reaches the second end 94 of the tunnel 18. In other embodiments, the projected images and/or the carousel 160 may accelerate and decelerate in order to create the illusion of varying speeds while the ride vehicle is in the tunnel. Upon exiting the tunnel 18, the ride vehicle 14 may proceed along the ride path 16 to any number of other features of the ride system 10, which may or may not include additional tunnels 18.

Figure 19:
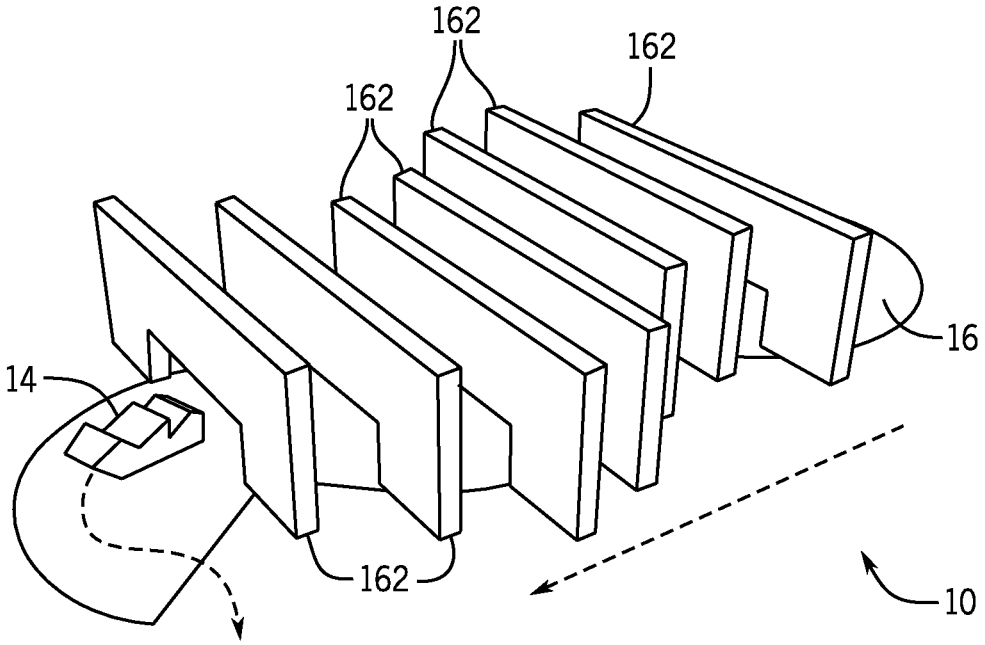
FIG. 19 is a perspective view of a ride vehicle exiting an embodiment of the tunnel having laterally moving set pieces as the set pieces reset in accordance with aspects of the present disclosure.

FIGS. 16, 17, 18, and 19 show an embodiment of the ride system 10 in which one or more set pieces 162 are moved in a substantially lateral direction 180, as opposed to the set pieces 162 mounted to the rotating carousel 160 shown in FIGS. 14 and 15. In the embodiment shown in FIGS. 16-19, once the ride vehicle 14 enters the tunnel 18, the ride vehicle 14 may either remain stationary at an intermediate position 92, or move slowly through the tunnel 18 as a plurality of set pieces 162 move in a substantially lateral direction 180 to create the illusion that the ride vehicle 14 is moving faster than it actually is. Though the set pieces shown in FIGS. 16-19 are rectangular in shape, it should be understood that this is merely to illustrate the movement of the set pieces 162, and that the set pieces may be of any shape or size. The set pieces 162 may be moved using one or more tracks, which may be at the tops, bottoms, or sides of the set pieces 162. However, other systems for moving the set pieces 162 may be possible. As shown in FIG. 19, once the ride vehicle 14 as passed through one or more of the set pieces 162, the set pieces move backward, opposite the lateral direction, to reset for the next ride vehicle 14 to enter the tunnel 18. It should be understood that FIGS. 16-19 show one possible feature of the ride system 10 and that the laterally moving set piece 162 feature may be combined with other features described herein (e.g., vanishing point tunnel, flexible tunnel, tunnel with entry and exit through single end, tunnel with carousel).

Figure 20:
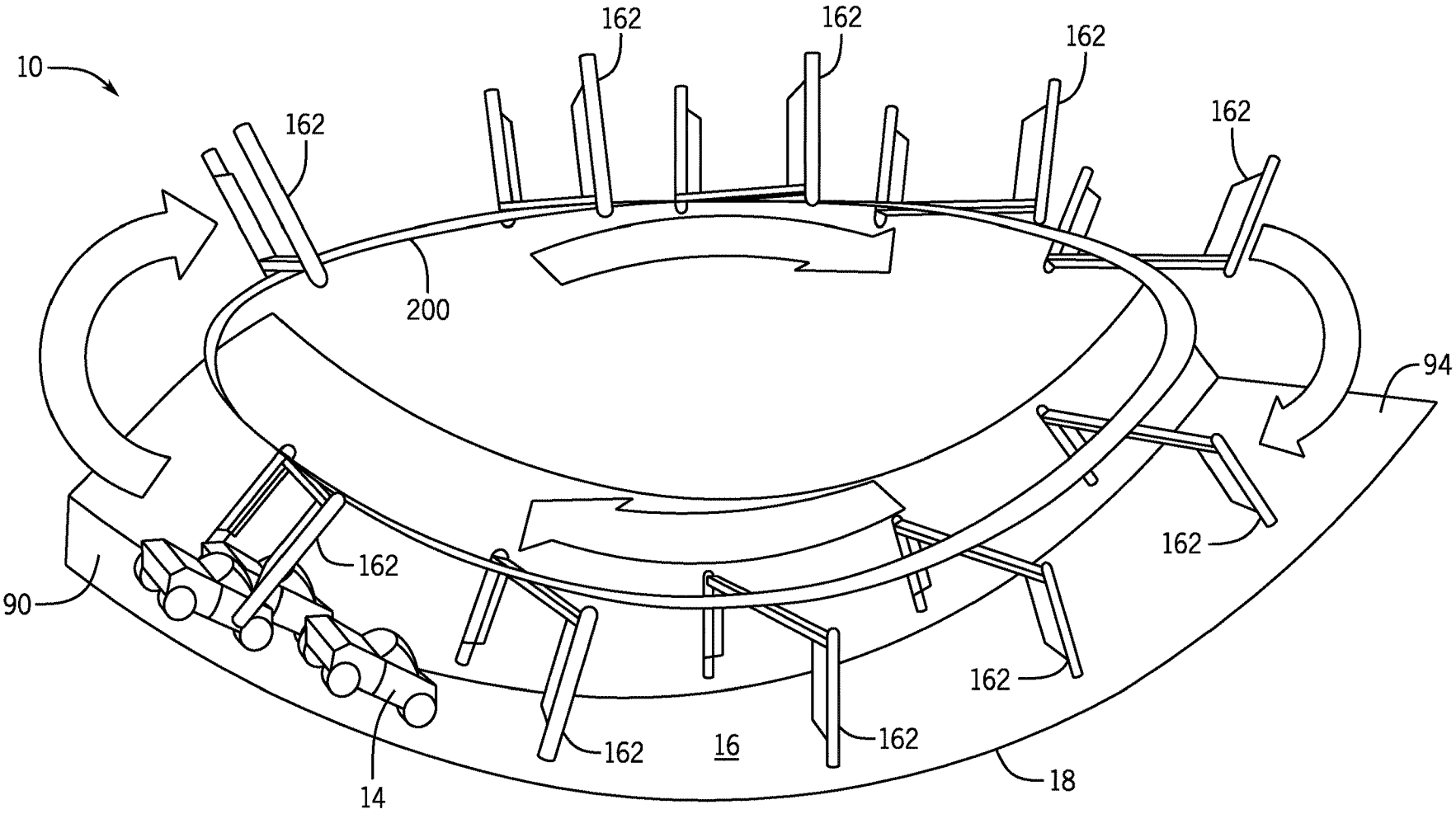
FIG. 20 is a perspective view of multiple ride vehicles in a treadmill-type embodiment of the tunnel having set pieces that cycle through the tunnel in accordance with aspects of the present disclosure.

FIG. 20 shows an embodiment of the ride system 10 in which set pieces 162 are guided through the tunnel by a treadmill-type system 200. In the embodiment shown in FIG. 20, a plurality of set pieces 162 are linked to one another by a belt, chain, or other flexible series of linkages. Though FIG. 20 shows attachment at the top of each set piece 162, attachment could also be from the bottom, a side of the set piece 162, or somewhere else.

As with other embodiments, the ride vehicle enters the tunnel through a first end 90. The ride vehicle may decelerate toward, and come to rest at, an intermediate position, or the ride vehicle 14 may proceed slowly through the tunnel 18. The set piece system 200 may then begin to move the set pieces 162 to create the illusion that the ride vehicle 14 is moving faster than it actually is. The set pieces 162 may be cycled above the ride path 16, under the ride path 16, or around the side (e.g., obscured by a wall 20), and back around in front of the ride vehicle 14. The same set pieces 162 may be guided by, over, or around the ride vehicle 14 an unlimited number of times, thus allowing the illusion of speed created by the set pieces 162 passing by, over, or around the ride vehicle 14 to continue indefinitely. It should be understood, however, that FIG. 20 is simplified to communicate the movement of the set pieces 162, and that the set piece system 200 may operate under the control of the control system 50, and/or in conjunction with the projection system 22, the sound system 66, the wind generation system 70, a motion base, actuators disposed throughout the ride system 10, or any other number of systems to enhance the illusion of speed.

After a period of time, the ride vehicle 14 accelerates toward the second end 94 of the tunnel 18. The rate of speed at which the set piece system 200 moves the set pieces 162 may change corresponding to the acceleration and deceleration of the ride vehicle. For example, the set piece system 200 may be configured to maintain a constant relative velocity between the ride vehicle 14 and the set pieces 162 in order to create the illusion of constant velocity. In some systems, this may be achieved by the control system 50 reacting to inputs from sensors 60 on the ride vehicle, sensors 64 in the tunnel 18, or sensors disposed elsewhere throughout the system 10, and adjusting the speed of the set pieces 162, or the speed of the ride vehicle accordingly. In other embodiments, this effect may be achieved without a control system 50. Additionally, the set piece system 200 may work in conjunction with other previously described systems (projection system 22, sound system 66, wind system 70) to create or enhance the illusion of speed.

Figure 21:
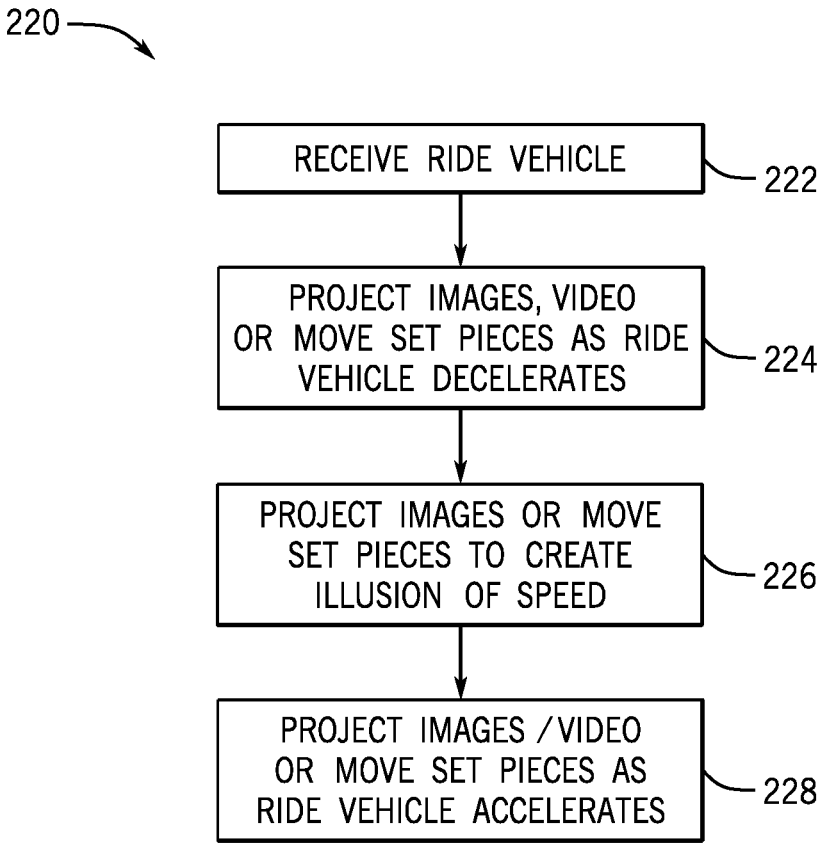
FIG. 21 is a block diagram of a process for creating the illusion of speed in the tunnel using the ride system in accordance with aspects of the present disclosure.

FIG. 21 shows a process 220 for creating the illusion of speed using the ride system 10. In block 222 the ride system 10 or the tunnel 18 receives the ride vehicle 14. In some embodiments, the ride vehicle 14 may enter the tunnel 18 from an open end at either side of the tunnel 18.

In block 224, images are projected and/or set pieces 162 are moved as the ride vehicle decelerates. The ride vehicle 14 decelerates between the first end 90 of the tunnel 18, where the ride vehicle 14 entered the tunnel 18, and an intermediate position 92 within the tunnel 18, from which the second end of the tunnel is not visible. As the ride vehicle decelerates, the projection system 22 projects images on the walls 20 of the tunnel 18, and/or the set piece system 200 moves set pieces 162 in order to create the illusion of speed. The projection system 22 may include a number of projectors 24, self-illuminating panels 26, or some other way to display images on a surface. In some embodiments, the projected images or set pieces 162 may accelerate, or appear to accelerate, at a rate opposite the deceleration of the ride vehicle 14 in order to create the illusion of constant velocity. For example, the ride vehicle 14 may enter the tunnel, decelerate, perhaps even stop, accelerate, and then exit the tunnel. During this time, the projection system may project images on the walls of the tunnel 20 such that the passenger 12 perceives that the ride vehicle 14 is moving through the tunnel 18 at a constant velocity. In other embodiments, the acceleration of the ride vehicle 14 and the projected images and/or set pieces may be mismatched to create the illusion of acceleration or deceleration. For example, the projected images may create the illusion for the passenger that the ride vehicle 14 has covered a much greater distance while it was in the tunnel 18 than it actually has.

The images projected onto the walls may simulate traveling through a tunnel in a car or a train. For example, the projected images may simulate a moving texture (e.g., brick, stone, rock, and so forth) onto the surface of a smooth wall. The projected images may include tunnel features, such as doors, windows, support structures, and so forth.) In yet other embodiments, the images projected onto the walls 20 of the tunnel 18 may not simulate a tunnel at all. For example, the projected images may include the sky, clouds, trees, buildings, bodies of water, wild life, aircraft, trains, other vehicles, and the like.

In some embodiments, the ride system 10 may also utilize other systems (e.g., a sound system 66, a wind generation system 70, lighting, a motion base 74, and a carousel 160) to further enhance the illusion of speed. The ride vehicle 14 may come to a stop at an intermediate position 92 within the tunnel 18. For example, accelerating projected images may be vibration of a motion base 74, increasing airflow through the tunnel cause by the wind generation system 70, and sounds produced by the sound system 66 (e.g., an engine revving, gear changes, simulation of the Doppler effect that corresponds to the projected images, and so forth). In some embodiments, the control circuitry 52 may receive inputs from one or more sensors 60 aboard the ride vehicle 14, and correspondingly control the projection system 22, the sound system 66, the wind generation system 70, the ride path 16, tunnel 18, set pieces 162, or other components according to a control program or algorithm to create an illusion of speed. In other embodiments, actuators throughout the ride system 10 may be actuated to create a repeatable ride experience that does not vary from cycle to cycle based on input from sensors.

In block 226, images are projected and/or set pieces are moved to create the illusion of speed. As previously discussed, the projection system 22 may project images on the walls 20 of the tunnel 18 and/or set pieces 162 may be moved through the tunnel 18 in order to create the illusion of speed for a passenger 12 in the ride vehicle 14. Other systems, such as a sound system 66, a wind generation system 70, lighting, a motion base 74, a carousel 160, and so forth, may be used to further enhance the illusion of speed. In some embodiments, the tunnel 18 may be disconnected from the ride path 16 and moved. After a period of time at which the ride vehicle 14 is stationary or in a slowed state at the intermediate position 92, the ride vehicle 14 begins to accelerate away from the intermediate position 92. In some embodiments, the ride vehicle 14 may accelerate toward the second end 94 of the tunnel 18 and proceed through the tunnel 18. In other embodiments, the ride vehicle 14 may accelerate back toward the first end 90 of the tunnel 18, exiting the tunnel 18 from the same end that it entered. In some embodiments, however, the ride vehicle 14 may not accelerate out of the tunnel 18. Instead, the ride vehicle 14 may proceed at a constant speed from the intermediate position 92 to the second end 94 of the tunnel.

In block 228, images are projected and/or set pieces are moved as the ride vehicle 14 accelerates away from the intermediate position 92. In some embodiments, the projected images or set pieces 162 may decelerate as the ride vehicle 14 accelerates, creating the illusion of constant speed. In other embodiments, the acceleration of the ride vehicle 14 and the acceleration or deceleration of the projected images or set pieces 162 may be mismatched in or to create the illusion of acceleration, deceleration, or to disorient the passenger 12. In some embodiments, the ride system 10 may use bright lights or darkness to disorient the passenger 12 while the ride vehicle 14 turns around. Other systems, such as a sound system 66, a wind generation system 70, lighting, a motion base 74, a carousel 160, etc., may be used to further enhance the illusion of speed.

Technical effects of the disclosure include creating the illusion of speed and/or directional transition for a passenger 12 without the ride vehicle 14 covering as much ground as the passenger 12 perceives. The systems and methods disclosed herein may be used to shrink the footprint of amusement park ride systems, reducing the amount of real estate necessary for the ride systems. The disclosed techniques may be used to increase the number of ride systems in an amusement park of a set size, to reduce the amount of real estate necessary for an amusement park having a desired number of ride systems, or to reduce the cost of building and operating an amusement park.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A ride system, comprising:

a tunnel comprising a first end and a second end, wherein the tunnel is curved between the first end and the second end;

a vehicle ride path extending within the tunnel from an entrance at the first end of the tunnel to an intermediate position within the tunnel, wherein the second end of the tunnel is not visible from the intermediate position;

a ride vehicle configured to travel along the vehicle ride path and to decelerate as the ride vehicle approaches the intermediate position;

a projection system configured to project moving images onto one or more walls of the tunnel; and a controller configured to control the projection system to project the moving images in a manner that is synchronized with the deceleration of the ride vehicle and such that a speed of the moving images relative to the one or more walls of the tunnel is inversely correlated with the deceleration.

2. The ride system of claim 1, wherein the projection system is configured to project the moving images along a surface of the tunnel such that the moving images transition along the surface in an accelerated manner as the ride vehicle decelerates toward the intermediate position.

3. The ride system of claim 2, wherein the accelerated manner is at a rate approximately opposite a deceleration rate of the ride vehicle such that a perceived speed of the ride vehicle is constant.

4. The ride system of claim 2, wherein the tunnel comprises an exit at the second end of the tunnel, and wherein the projection system is configured to decelerate transition of the moving images along the surface as the ride vehicle accelerates away from the intermediate position toward the exit of the tunnel.

5. The ride system of claim 4, wherein the projection system is configured to decelerate the transition of the moving images along the surface at a rate approximately opposite an acceleration rate of the ride vehicle such that a perceived speed of the ride vehicle is constant.

6. The ride system of claim 1, wherein the ride system comprises one or more sensors configured to detect an actual speed of the ride vehicle, a position of the ride vehicle, an acceleration rate of the ride vehicle, or a combination thereof.

7. The ride system of claim 1, comprising a motion base disposed at the intermediation position.

8. The ride system of claim 1, comprising an actuator configured to actuate the tunnel.

9. The ride system of claim 8, wherein the actuator is configured to actuate the second end of the tunnel to simulate a right turn, a left turn, an upward slope, a downward slope, or a combination thereof.

10. The ride system of claim 1, wherein the projection system is configured to project the images along a length of the tunnel to emulate a constant speed as a perceived speed while an actual speed of the ride vehicle changes.

11. The ride system of claim 1, wherein the projection system is configured to project the images along a length of the tunnel, such that a change in the speed of the moving images is inversely proportional to a change in an actual speed of the ride vehicle.

12. The ride system of claim 1, wherein a cross-sectional area of the tunnel decreases from the first end to the second end in a conical shaped fashion.

13. A method comprising:

directing a ride vehicle from an entrance at a first end of a tunnel toward an intermediate position within the tunnel, wherein the intermediate position is disposed between the first end of the tunnel and a second end of the tunnel, and wherein the tunnel is curved such that the second end of the tunnel is not visible from the intermediate position;

decelerating the ride vehicle as the ride vehicle approaches the intermediate position; and projecting images onto one or more walls of the tunnel with a projector, wherein the images are synchronized with the deceleration of the ride vehicle by a projector controller such that a perceived speed of the ride vehicle from a perspective of the ride vehicle, exceeds an actual speed of the ride vehicle.

14. The method of claim 13, wherein the images accelerate at a rate approximately opposite a deceleration rate of the ride vehicle such that the perceived speed of the ride vehicle is constant.

15. The method of claim 13, comprising:

accelerating the ride vehicle from the intermediate position toward the second end of the tunnel; and projecting images onto the one or more walls of the tunnel, wherein the images are synchronized with the acceleration of the ride vehicle such that the perceived speed of the ride vehicle exceeds the actual speed of the ride vehicle.

16. The method of claim 15, wherein the projected images decelerate at a rate approximately opposite an acceleration rate of the ride vehicle such that the perceived speed of the ride vehicle is constant.

17. The method of claim 13, comprising tilting or vibrating the ride vehicle via a motion base disposed at the intermediate position.

18. The method of claim 13, comprising actuating the second end of the tunnel, via an actuator, to simulate a right turn, a left turn, an upward slope, a downward slope, or a combination thereof.

19. A control system, configured to:

direct a ride vehicle from an entrance at a first end of a tunnel toward an intermediate position within the tunnel, wherein the intermediate position is disposed between the first end of the tunnel and a second end of the tunnel, and wherein the tunnel is curved such that the second end of the tunnel is not visible from the intermediate position;

decelerate the ride vehicle as the ride vehicle approaches the intermediate position; and control a projection system to project images onto one or more walls of the tunnel, wherein the projected images are synchronized with the deceleration of the ride vehicle such that a perceived speed of the ride vehicle from a perspective of the ride vehicle exceeds an actual speed of the ride vehicle.

20. The control system of claim 19, wherein the control system is configured to control the ride vehicle to accelerate the ride vehicle from the intermediate position toward an exit at the second end of the tunnel, and wherein the projection system is configured to project images onto the one or more walls of the tunnel, wherein the projected images are synchronized with the acceleration of the ride vehicle such that the perceived speed of the ride vehicle exceeds the actual speed of the ride vehicle.

21. The control system of claim 19, wherein the control system is configured to control a motion base disposed at the intermediate position, wherein the motion base is configured to tilt or vibrate the ride vehicle.

22. The control system of claim 19, wherein the control system is configured to control an actuator to actuate the second end of the tunnel to simulate a right turn, a left turn, an upward slope, a downward slope, or a combination thereof.

23. The control system of claim 19, comprising one or more sensors configured to detect a position of the ride vehicle, the actual speed of the ride vehicle, an acceleration rate of the ride vehicle, or a combination thereof.

* * * * *